US008707946B2

(12) United States Patent
Leikam et al.

(10) Patent No.: US 8,707,946 B2
(45) Date of Patent: Apr. 29, 2014

(54) HOUSEHOLD APPLIANCE, IN PARTICULAR A KITCHEN RANGE

(75) Inventors: Jurgen Leikam, Hilpoltstein (DE); Alwin Neukamm, Wilhermsdorf (DE); Jochen Holzinger, Rothenburg O.D. Tauber (DE)

(73) Assignee: Electrolux Home Products Corporation N.V., Zaventem (BE)

( * ) Notice: Subject to any disclaimer, the term of this patent is extended or adjusted under 35 U.S.C. 154(b) by 777 days.

(21) Appl. No.: 12/300,555

(22) PCT Filed: Feb. 21, 2007

(86) PCT No.: PCT/EP2007/001477

§ 371 (c)(1),
(2), (4) Date: Nov. 12, 2008

(87) PCT Pub. No.: WO2007/137637

PCT Pub. Date: Dec. 6, 2007

(65) Prior Publication Data

US 2009/0183725 A1 Jul. 23, 2009

(30) Foreign Application Priority Data

May 26, 2006 (DE) ..... 10 2006 024 739

(51) Int. Cl.
*F24C 15/00* (2006.01)

(52) U.S. Cl.
USPC ..... 126/211; 126/1 R; 219/700; 200/5 A

(58) Field of Classification Search
USPC ..... 126/211, 1 R; 219/702; 200/5 A
See application file for complete search history.

(56) References Cited

U.S. PATENT DOCUMENTS

| | | | | |
|---|---|---|---|---|
| 4,750,720 | A * | 6/1988 | Wolf et al. | 267/219 |
| 4,894,493 | A * | 1/1990 | Smith et al. | 200/5 A |
| 5,801,542 | A * | 9/1998 | Kajiwara et al. | 324/756.02 |
| 6,563,059 | B2 * | 5/2003 | Lee | 177/177 |
| 6,791,041 | B1 * | 9/2004 | Chen et al. | 200/51 R |
| 2004/0144775 | A1 * | 7/2004 | Kim et al. | 219/702 |
| 2004/0156168 | A1 * | 8/2004 | LeVasseur et al. | 361/681 |
| 2006/0002089 | A1 * | 1/2006 | Tran et al. | 361/709 |

FOREIGN PATENT DOCUMENTS

| | | | |
|---|---|---|---|
| EP | 1120999 | A2 | 8/2001 |
| EP | 1139695 | A2 | 10/2001 |
| EP | 1651022 | A | 4/2006 |
| EP | 1662207 | A | 5/2006 |

OTHER PUBLICATIONS

International Search Report for PCT/EP2007/001477 dated Aug. 31, 2007, 2 pages.

* cited by examiner

*Primary Examiner* — Avinash Savani
(74) *Attorney, Agent, or Firm* — Pearne & Gordon LLP

(57) ABSTRACT

The invention relates to a household appliance (1), in particular a kitchen range with at least one control and/or display circuit board (2) that is set in an appropriate mounting recess (3), said control and/or display board (2), when installed, being tightly pressed against another component (4) (specifically against the bottom surface of a glass-ceramic stovetop or of a control panel. To ensure good tolerance compensation in cost-effective fashion and, thus, secure pressure contact between the control and display board and the said other component, the invention proposes the placement of the control and/or display board (2) in a socket (5) in the mounting recess (3), which socket (5) is provided with several spring elements (6) so configured and arranged as to press against the control and/or display board (2) on its side facing away from the said other component (4).

15 Claims, 3 Drawing Sheets

HOUSEHOLD APPLIANCE, IN PARTICULAR A KITCHEN RANGE

The invention relates to a household appliance, in particular a kitchen range with at least one control and/or display circuit board that is set in an appropriate mounting recess, said control and/or display board, when installed, being tightly pressed against another component.

Household appliances and especially kitchen ranges are equipped with control and display circuit boards as needed for displaying information and for entering operating commands. The control and display boards are usually set in a corresponding mounting recess. A glass-ceramic plate or a stove panel is then overlaid from the top. It is important to make sure that, while in use, the control and display board is tightly pressed against the glass-ceramic plate or stove panel to ensure flawless operation.

In prior art this has been accomplished by inserting compression springs, leaf springs or retaining frames with spring elements. The objective in all cases is to press the control and display board against the glass-ceramic plate or stove panel by applying spring tension especially in order to compensate for tolerances in production and to ensure perfectly flush contact of the control and display board with or in the household appliance.

The necessary protection against moisture infiltration is ensured by separate provisions. Examples include cross braces provided with an elastic seal. Use has also been made of cross braces whose openings are sealed with a silicone glue. Also suitable are plastic enclosures with glued-on gaskets.

In one prior-art solution a plastic support is suspended in a metal wall and the packing is accomplished by means of a separately glued-on sealing strip.

In another solution, compression springs press the electronics, meaning the control and display board, against the bottom surface of the glass-ceramic plate or stove panel in which case the seal is provided in the form of a metal cross brace and a sealing profile.

It is also possible to screw the electronics onto a metal support and to provide the packing by introducing a silicone glue in the resulting hollow space.

A drawback with these earlier solutions is that in some cases they are relatively complex, making the production of the bond cost-intensive. Also, in the case of more significant production tolerances, complete compensation for these cannot always be assured. Specifically, a dependable pressure contact between the control and display board and the bottom surface of the glass-ceramic plate or stove panel is not always guaranteed. As another drawback, some solutions involve the use of a significant number of different parts, thus resulting in complex logistics. Moreover, the assembly process is not always a simple matter, with a corresponding impact on costs. And in the case of some of the earlier solutions it has been found that, over time, moisture can penetrate the area around the control and display board.

It is therefore the objective of this invention to improve the design of household appliances of the type referred to above in a manner whereby the aforementioned drawbacks can be avoided. In particular, dependable tolerance compensation during the installation of the control and display board is to be ensured. It should also guarantee protection against moisture penetration of the area around the control and display board even over the long term. In other words, the control and display board should always securely hug the glass-ceramic plate or stove panel under any production-related circumstances.

The solution by which the invention achieves this objective is characterized in that the control and display board is positioned in a socket within a mounting recess, which socket is provided with a number of springs so configured and arranged as to exert pressure on the control and/or display board on the side facing away from the other component.

That other component is preferably a glass plate or glass-ceramic plate or stove panel.

The socket and the spring elements may be designed as a one-piece module or consist of two components. In the latter case the spring elements are mounted on a support which is positioned on or in the socket.

The socket and, if applicable, the support preferably have a rectangular outer contour.

The spring elements may consist of a resilient plastic or rubber material. They may also be in the form of convex protuberances extending in the direction of the control and/or display board. In that case a hemispherical or spherical-segment shape of the spring elements has proved advantageous. The spring elements are preferably arranged in at least two rows.

To optimize the circumferential positioning of the control and/or display board the socket may additionally be provided with a number of centering elements attached to an inward-pointing bezel. They may be constituted of ridges extending in the vertical direction.

As an alternative centering feature, the socket may be provided with at least one mandrel-shaped centering pin that engages in a matching hole in the control and/or display board.

It will be desirable to provide the socket and/or the support with a continuous seal along the perimeter facing the said other component. That seal may consist of a soft, elastic material such as silicone.

Additionally, the socket may have at least one peripheral cut-out, preferably in the bottom area of the socket. That allows cables etc. to be fed through without difficulty.

As a particularly preferred aspect, the spring elements complete with the socket or support are jointly produced in one injection-molding process. In that process the spring elements on the one hand and the socket or support on the other may be produced from two different plastic materials. Preferably, the spring elements and/or the support are made from silicone.

The concept according to the invention makes it possible in all cases to optimize the compensation for production tolerances of the individual components so that the control and/or display board will always press firmly against the glass-ceramic plate or the stove panel. The proposed solution thus improves the quality of the household appliance.

The solution according to the invention can be implemented in a very cost-effective manner.

Implementing the invention requires but few components, which simplifies the logistics and reduces the cost.

Finally, the simplicity of assembly notwithstanding, this approach always ensures fully functional sealing of the control and display board.

The attached drawings illustrate a design example of the invention:

Figure 1:
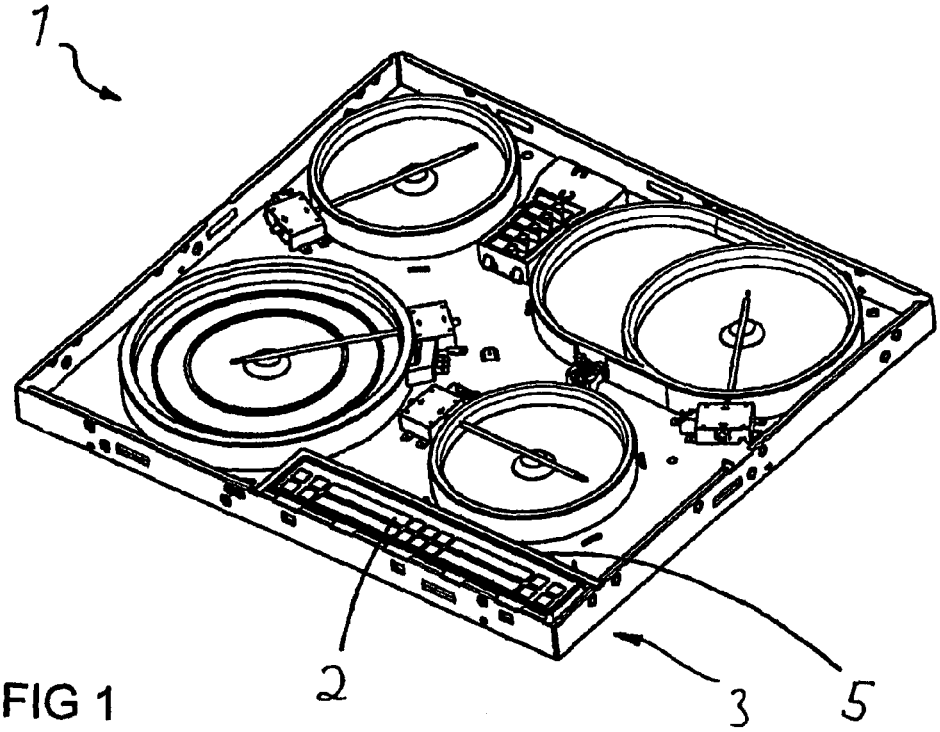
FIG. 1 is a perspective view of part of a household appliance, in particular the stovetop area of a kitchen range.
Figure 2:
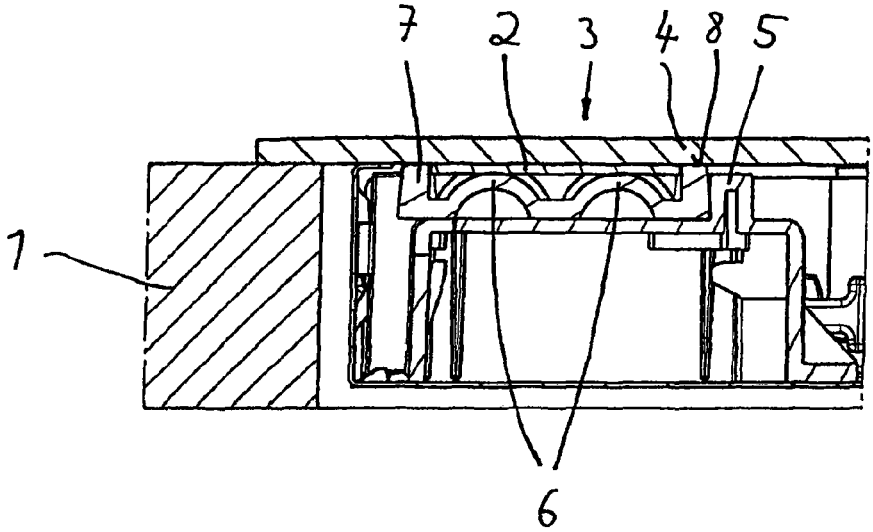
FIG. 2 is a section view of the mounting recess for a control and/or display board.

FIG. 1 shows a household appliance 1, i.e. the stovetop area of a kitchen range. Positioned in a mounting recess 3 is a control and/or display board 2 that serves to control certain functions (heating, timer, operating modes etc.) and, respectively, to display certain information. Another component 4, not illustrated in this figure (see FIG. 4) consists of a glass-ceramic plate that is placed on the stovetop from above. What is important is that the control and/or display board 2 is always pressed firmly from underneath against the bottom surface of the glass-ceramic plate to ensure proper function and to prevent moisture from entering the area around the control and/or display board 2.

Figure 3:
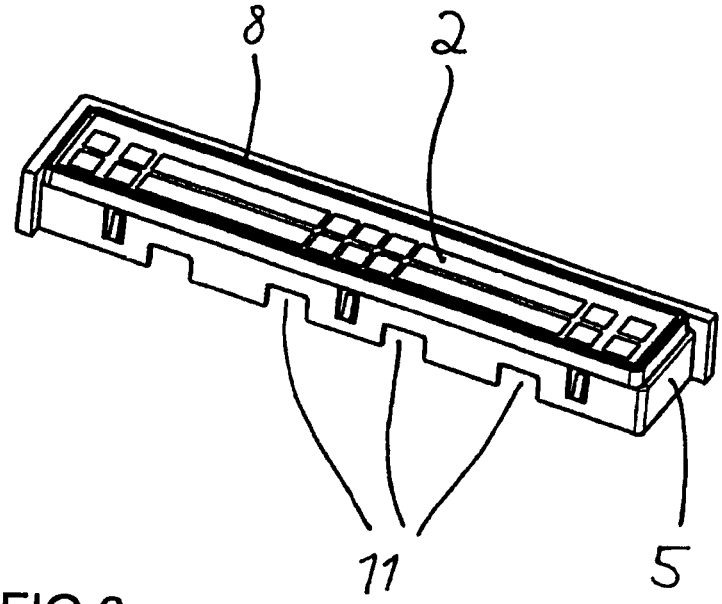
FIG. 3 is a perspective view of the control and/or display board in a socket.
Figure 4:
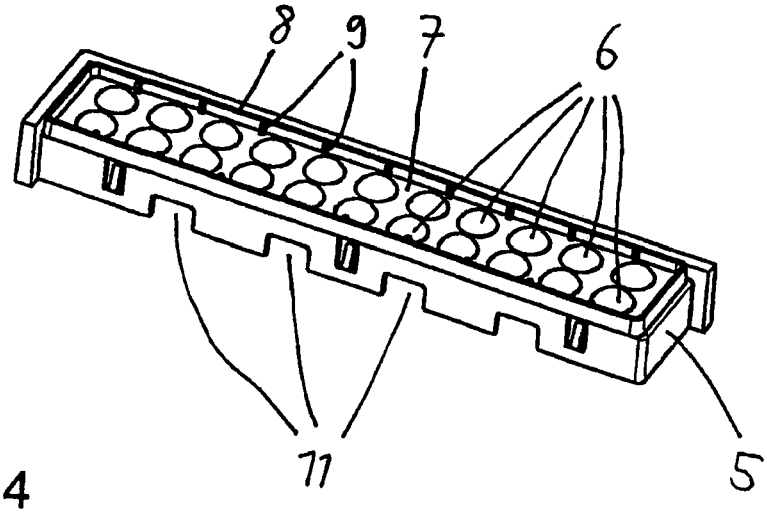
FIG. 4 is a perspective view of the socket with a support inserted in it and with a number of spring elements.
Figure 5:
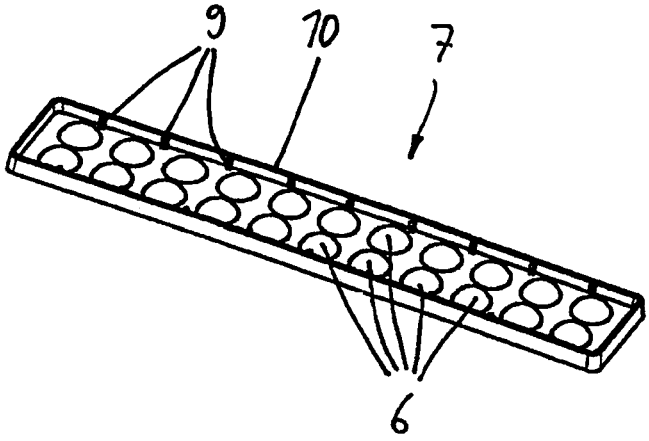
FIG. 5 is a perspective view of the support with a number of spring elements.
Figure 6:
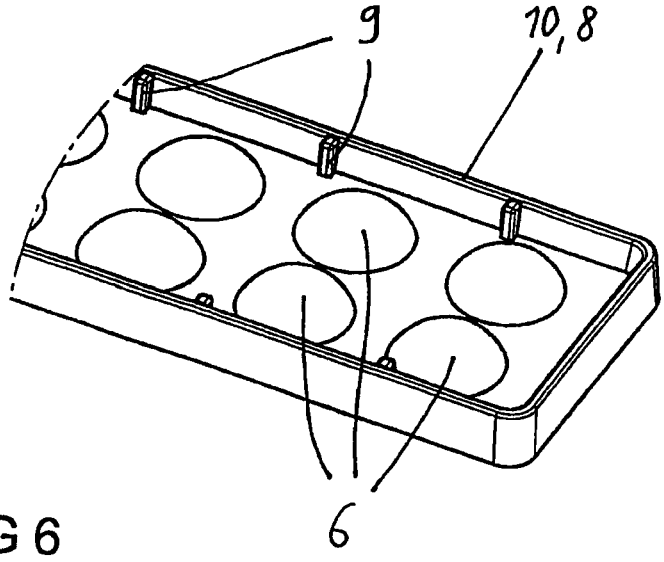
FIG. 6 is an enlarged illustration of the support together with spring elements.

The structure of the support for the control and/or display board 2 is shown in some detail in FIGS. 2 to 6. As is most clearly seen in FIGS. 2, 3 and 4, the socket 5, which may be made from sheet metal, is rectangular. It includes a cavity that accepts a support 7 (see FIGS. 5 and 6), as illustrated in FIG. 4. The support 7 is a flat component with a number of spring elements 6. As can be seen most clearly in FIGS. 2 and 6, the spring elements 6 are shaped as spherical caps, with the tops of the individual spherical caps serving as support points for the control and/or display board 2 that is placed on the support 7. FIG. 3 shows the board in place.

To properly center the control and/or display board 2 in the socket 5, the support 7 features in its peripheral area a number of vertically extending centering elements 9. The top edge of the lateral rim 8 of the support 7, protruding upward, forms a continuous sealing rim 10, serving as a gasket that seals the control and/or display board 2 from the inside of the socket 5 when the glass-ceramic plate 4 is in place. The continuous seal 10 may consist of a soft, elastic material such as silicone, thus offering a good sealing effect that prevents moisture from entering.

To permit the feed-through of cables and similar components (including, for instance, electronic modules), the bottom section of the socket 5 is provided with a number of cut-outs 11.

The support 7 may be a two-component injection-molded part whose base-support constituent consists of a harder plastic than the spring elements 6 which may be made from silicone. Specifically, to accommodate the control and/or display board 2, the elastic, thermally stable component 7 is designed in a way whereby the bottom configuration is such as to ensure tight contact of the control and/or display board 2 with the bottom surface of the glass-ceramic plate 4. The spring elements 6 will always compensate for any existing tolerances.

The other function performed by the support 7 is that of securing and centering the control and/or display board 2. The illustration shows vertically extending ridges serving as the centering elements 9 engaging the outer edge of the control and/or display board 2. As an example of an alternative solution (not illustrated), the centering elements 9 may be in the form of mandrel-shaped pins that engage in matching perforations in the control and/or display board 2.

The concept proposed by this invention permits the easy-to-assemble integration of different functionalities such as sealing, pressure-mounting against die control surface (e.g. glass-ceramic plate or stove panel) and centering of the control and/or display board 2 in the support 7.

Moreover, given the geometric arrangement of the spring elements 6, it is possible to variably adjust the resulting and needed pressures and elasticity values to the specific requirement at hand.

In particular, to achieve an optimal sealing/pressure ratio, the parts and especially the support 7 with its integrated spring elements 6, can be produced by a 2-component injection molding process.

LIST OF REFERENCE NUMBERS

1 household appliance
2 control and/or display board
3 mounting recess
4 other component (glass-ceramic plate)
5 socket
6 spring elements
7 support
8 rim
9 centering elements
10 continuous sealing rim
11 cut-outs

The invention claimed is:

1. Household appliance (1), in particular a kitchen range, comprising at least one control and/or display board (2) that is set in an appropriate mounting recess (3), said control and/or display board (2), when installed, being tightly pressed against another component (4), wherein the control and/or display board (2) is positioned in a socket (5) within the mounting recess (3), said socket (5) containing a number of spring elements (6) so configured and arranged as to press the control and/or display board (2) away from the socket and toward the other component, the spring elements being positioned between the socket and the control and/or display board;

the spring elements (6) are produced from a resilient plastic or rubber material;

the spring elements (6) are arrayed in at least two parallel rows;

the spring elements (6) are constituted of convex protuberances protruding in the direction of the control and/or display board (2);

the spring elements (6) are of a hemispherical or spherical-segment shape; and a number of the spring elements (6) are arranged side by side.

2. Household appliance as in claim 1, wherein the said other component (4) is a glass plate or glass-ceramic plate.

3. Household appliance as in claim 1, wherein the said other component (4) is a stove panel.

4. Household appliance as in claim 1, wherein the socket (5) and the multiple spring elements (6) are composed of a single one-piece module.

5. Household appliance as in claim 1, wherein the socket (5) and the multiple spring elements (6) consist of two components, of which the spring elements (6) are attached to a support (7) that is mounted on or in the socket (5).

6. Household appliance as in claim 5, wherein the socket (5) and, if applicable, a support (7) has/have a rectangular outer contour.

7. Household appliance as in claim 1, wherein the socket (5) is provided, on an inward-pointing rim (8), with a number of centering elements (9).

8. Household appliance as in claim 7, wherein the centering elements (9) consist of vertically extending ridges.

9. Household appliance as in claim 1, wherein the socket (5) is provided with at least one mandrel-shaped centering element that engages in a matching perforation in the control and/or display board (2).

10. Household appliance as in claim 5, wherein the socket (5) and/or the support (7) is/are provided with a continuous sealing rim on the side facing the said other component (4).

11. Household appliance as in claim 1, wherein the socket (5) is provided with a minimum of one cut-out (11) in its perimeter.

12. Household appliance as in claim 11, wherein the minimum of one cut-out (11) is situated in the bottom section of the socket (5).

13. Household appliance as in claim 1, wherein the spring elements (6) together with the socket (5) or support (7) are jointly produced in one injection-molding process.

14. Household appliance as in claim 13, wherein the spring elements (6) and, respectively, the socket (5) or the support (7) are produced from two different plastic materials.

15. Household appliance as in claim 13, wherein the spring elements (6) and/or the support (7) consist of silicone.

* * * * *